US009379458B2

(12) United States Patent
Jenrich

(10) Patent No.: US 9,379,458 B2
(45) Date of Patent: Jun. 28, 2016

(54) ELECTRICAL CONNECTOR ELEMENT

(75) Inventor: André Jenrich, Leipzig (DE)

(73) Assignee: FEW FAHRZEUGELEKTRIKWERK GMBH & CO. KG, Zwickau (DE)

( * ) Notice: Subject to any disclaimer, the term of this patent is extended or adjusted under 35 U.S.C. 154(b) by 119 days.

(21) Appl. No.: 13/504,001

(22) PCT Filed: Sep. 28, 2011

(86) PCT No.: PCT/EP2011/066916

§ 371 (c)(1),
(2), (4) Date: Apr. 25, 2012

(87) PCT Pub. No.: WO2012/149985

PCT Pub. Date: Nov. 8, 2012

(65) Prior Publication Data

US 2012/0305311 A1 Dec. 6, 2012

(30) Foreign Application Priority Data

May 3, 2011 (DE) ..... 20 2011 100 176
May 19, 2011 (DE) ..... 20 2011 100 906

(51) Int. Cl.
*H02G 15/02* (2006.01)
*H01R 4/02* (2006.01)
*H01R 11/12* (2006.01)
(Continued)

(52) U.S. Cl.
CPC ..... *H01R 4/023* (2013.01); *H01R 4/02* (2013.01); *H01R 4/625* (2013.01); *H01R 11/12* (2013.01); *H01R 4/58* (2013.01); *H01R 4/62* (2013.01); *H01R 2201/02* (2013.01); *H01R 2201/26* (2013.01)

(58) Field of Classification Search
CPC .... H01R 4/023; H01R 4/625; H01R 2201/02; H01R 2201/26; H01R 11/12; H01R 11/22; H01R 4/02; H01R 4/58; H01R 4/62; H01R 4/183; H05K 3/06; H05K 3/02; H05K 3/262; H05K 3/4015; H05K 3/4092
USPC ..... 174/75 R, 84 C, 94 R, 74 R; 439/34, 730, 439/874, 932, 948
See application file for complete search history.

(56) References Cited

U.S. PATENT DOCUMENTS 3,534,148 A * 10/1970 Bange ..... 174/255
4,199,214 A * 4/1980 Pearce et al. ..... 439/620.26
(Continued)

FOREIGN PATENT DOCUMENTS

DE 202 03 202 6/2002
DE 10 2006 047 764 4/2008
WO WO 2009146818 A1 * 12/2009 ..... E04C 2/34

*Primary Examiner* — Ishwarbhai B. Patel
*Assistant Examiner* — Paresh Paghadal
(74) *Attorney, Agent, or Firm* — Hamre, Schumann, Mueller & Larson, P.C.

(57) ABSTRACT

The invention relates to an electrical connector element for creating a contact to a conductive structure, the same being located on a flat support, by means of a thermal bonding material, wherein means for fixing a conductor, the same being preferably flexible, are arranged on the side of said support which faces away from the conductive structure. According to the invention, the connector element is designed as a soldering foot which has the shape of a single circular ring, or of multiple circular rings arranged laterally.

9 Claims, 2 Drawing Sheets

(51) Int. Cl.
*H01R 4/58* (2006.01)
*H01R 4/62* (2006.01)

(56) References Cited

U.S. PATENT DOCUMENTS 5,569,433 A * 10/1996 Chen et al. ..... 420/557
6,267,630 B1 * 7/2001 Machado ..... 439/876
2002/0111081 A1 * 8/2002 Machado ..... 439/876
2007/0224842 A1 * 9/2007 Hoepfner et al. ..... 439/34
2011/0104958 A1 * 5/2011 Kwon et al. ..... 439/816
2012/0131882 A1 * 5/2012 Sporn et al. ..... 52/788.1
2013/0043066 A1 * 2/2013 Cholewa et al. ..... 174/257

* cited by examiner

ELECTRICAL CONNECTOR ELEMENT

CROSS-REFERENCE TO RELATED APPLICATIONS

Not applicable

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable

STATEMENT REGARDING PRIOR DISCLOSURES BY THE INVENTOR OR A JOINT INVENTOR

Not applicable

BACKGROUND OF THE INVENTION

1. Field of the Invention

The invention relates to an electrical connector element for creating a contact to a conductive structure, the same being located on a flat support, by means of a thermal bonding material, wherein means for fixing a conductor, the same being preferably flexible, are arranged on the side of the connector element which is opposite the conductive structure, as according to claim 1.

2. Description of Related Art Including Information Disclosed Under 37 CFR 1.97 and 1.98

An electrical connector is known from DE 202.03 202 U1, particularly a crimped or swaged connection, for an electrical device intended for arrangement on at least one window pane, the latter being part of a means of conveyance, particularly a motor vehicle. Said electrical connector can be, by way of example, an antenna. The electrical connector has at least one solder pad, wherein the same is substantially flat and is intended to be soldered onto the window pane. The electrical connector also has at least one push-in terminal with is both connected to the solder pad by means of welding or soldering, and also fixes at least one electrical cable via a push-in connection. Said push-in terminal is particularly a crimped push-in terminal.

According to the solution suggested in the prior art, the connection between the solder pad and the push-in terminal is realized by at least one connector element, wherein the connector element is designed in such a manner that the push-in terminal can be bent in the reverse path in the region of the solder pad, and/or beyond the region of the solder pad.

In this way, the prior art intends to ensure a durable, stable, and reliable connection between the solder pad and the push-in terminal.

A soft solder having improved characteristics at temperatures greater than 150° C. and containing no lead is known from DE 10 2006 047 764 A1. The lead-free soft solder is based on a solder alloy of Sn, In, and Ag, comprising between 88% and 98.5% Sn by weight, between 1 and 10% In by weight, between 0.5 and 3.5% Ag by weight, and 0 to 1% Cu by weight, and is doped with a crystallization modifier, particularly neodymium at a maximum of 100 ppm. This solder should possess excellent bonding characteristics for the connectors used therewith, as well as high fatigue strength.

In addition, the prior art has also suggested electrical connector elements for a window pane, as well as an environmentally friendly method for the production of such a connector element. In this case, the window pane has an electrical connector element for vehicles with electrically conductive structures, for example heating conductors or antennae. The electrically conductive structures are brought into contact with on-board power via connector elements soldered onto Said electrically conductive structures. Due to different coefficients of thermal expansion for the materials used mechanical stresses arise during both manufacture and eventual operation, wherein said stresses should not be ignored, placing a load on the window pane. These stresses can lead to a break in the window pane or destruction of the contact.

Solders used to date which contain lead possess high ductility and can consequently receive and/or compensate for mechanical stresses between the electrical connector element and the window pane. However, the use of solders containing lead is problematic for reasons of health and environmental protection, and is increasingly avoided.

For the reason that solders free of lead do not possess the ductility indicated above, or only do so to a limited degree, it is necessary to pre-emptively minimize the mechanical stresses resulting from differing coefficients of expansion which occur during manufacture and/or later use.

BRIEF SUMMARY OF THE INVENTION

For this reason, the problem addressed by the invention is that of providing a refined electrical connector element for creating a contact with a conductive structure, the same being located on a flat support, by means of a thermal bonding material, wherein unavoidable forces resulting from different coefficients of expansion are reduced, and/or the effects of these realized forces are minimized, by means of selecting the form and the material of the connector element.

The problem addressed by the invention is solved by an electrical connector element according to the combination of features in claim 1, wherein the independent claims comprise at least advantageous embodiments and implementations thereof.

The invention proceeds from an electrical connector element for creating a contact to a conductive structure located on a flat support.

The flat support is preferably a window pane made of safety glass, particularly for use in motor vehicle applications. The conductive structure is an electrically conductive entity, for example a heating conductor arrangement which is produced by means of screen printing, or an antenna structure for the operation of a radio receiver in the motor vehicle, or another electronic device, including a navigation device, for example.

The thermal bonding material is a lead-free solder which is located on the side of the electrical connector element which has no end sleeve or any other similar means for the attachment of a flexible conductor.

The connector element according to the invention is designed as a soldering foot with a shape approximating that of a figure eight, or approximating that of a circle, and also having one or more breaks.

Also, the soldering foot preferably consists of multiple rings or segments of rings which engage with each other or touch each other.

In one embodiment, the soldering foot consists of two rings formed into a figure eight.

The means for fixing the preferably flexible conductor are situated in the flat region where the rings engage with or touch each other. Sufficient surface area of the contact material is available at this site.

The thermal bonding material is applied to one side of the connector element, and takes on a surface, area at this site, wherein said surface area is smaller than the surface area of the ring or rings.

The bonding material preferably does not extend to the outer edge of the ring or rings, but rather only to a prespecified distance. In addition, a material-free ring can be present. This ring can also have at least one break.

In addition, the bonding material is preferably situated on the connector element as a solder blank.

The connector element consists of an iron-nickel or iron-chromium alloy, or a mixture thereof.

The connector element preferably consists of FeCr28, FeNi42, FeNi48, or FeNi52.

The bonding material has the following alloys, at least as components thereof: Bi57Sn42Ag0, Bi57Sn40Ag3, SnAg3.8Cu0.7, Sn55Bi44Ag1, or Sn95.5Ag3Cu.0.

The materials suggested for the connector elements have a coefficient of expansion which is very close to the coefficient of expansion of automotive glass windows, specifically $9\times10^{-6}$/K, approximately. Stresses which occur are distributed concentrically in the glass by means of the special shape of the soldering foot, and received by the glass material, wherein no danger of breakage exists.

In one embodiment, the soldering foot has a ring with an inner diameter of 8 mm and an outer diameter of 16 mm, with a material thickness of approx. 0.8 mm. The figure-eight shape of the soldering foot mentioned above can also be modified to a double eight figure without deviating from the teaching of the invention.

The surprising finding has been made that, in contrast to a configuration where the soldering foot is a flat, solid form, the ring or ring-like shape mentioned above leads to substantially reduced stresses which occur as a result of the expansion coefficient, and to substantially reduced forces in the glass material. The result is long-term stability and quality assurance in the electrical connection and/or contact.

BRIEF DESCRIPTION OF THE SEVERAL VIEWS OF THE DRAWING(S)

The invention is explained with greater specificity with reference to an embodiment thereof and to the figures, wherein.

DETAILED DESCRIPTION OF THE INVENTION

As shown in the figures, the electrical connector element is made of a metal alloy material, for example FeCr28, an iron-nickel or iron-chromium alloy.

The connector element is designed as a soldering foot which has the shape of a circular ring or a shape approximating that of a circular ring.

Figure 1:
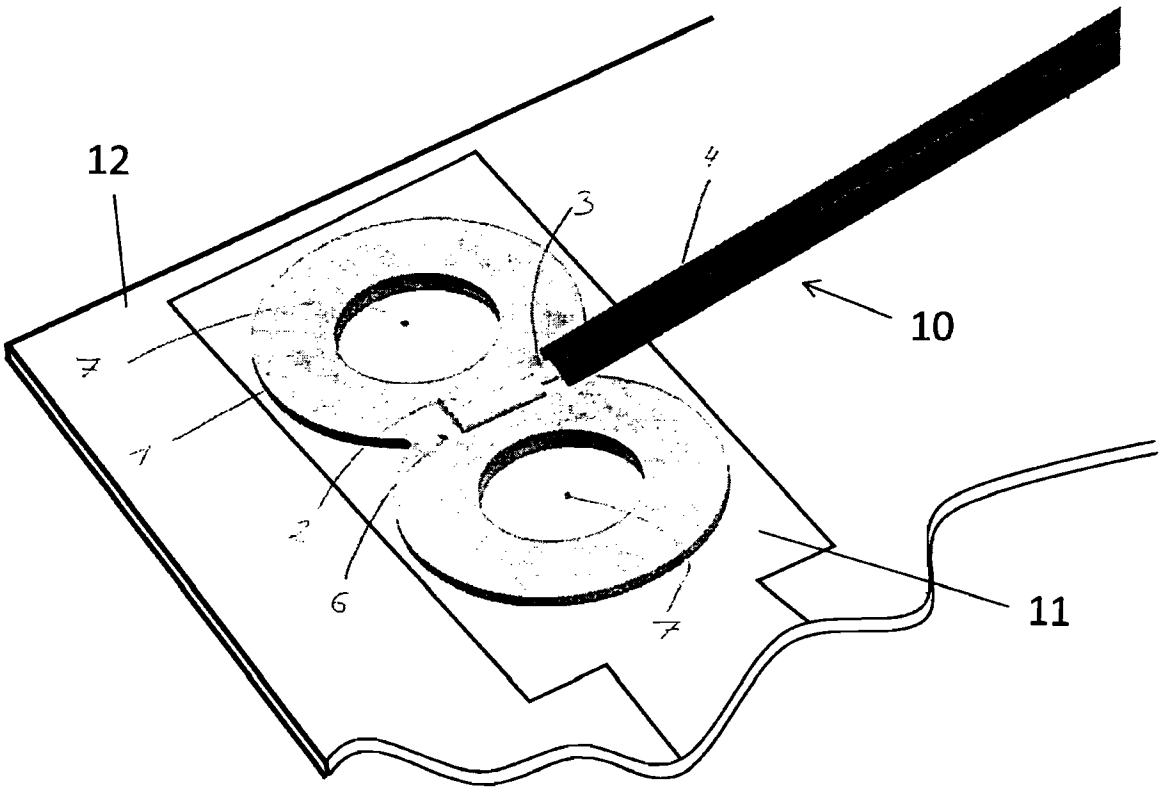
FIG. 1 shows a perspective top view of a connector element provided on a conductive structure located on a flat support. The connector element has an electrical conductor connected via an end sheath thereof.

Referring to FIG. 1, a connector element 10 includes a soldering foot 1 having circular rings which engage with each other, forming a figure eight. An end sheath 2 is situated on the upper side of the soldering foot 1 and receives an electrical conductor 3. The latter has an insulation 4.

In FIG. 1, the connector element 10 is shown to be provided on a conductive structure 11 located on a flat support 12.

On the bottom side, the soldering foot 1 has a solder blank 5 which likewise has the shape of a circular ring.

Figure 2:
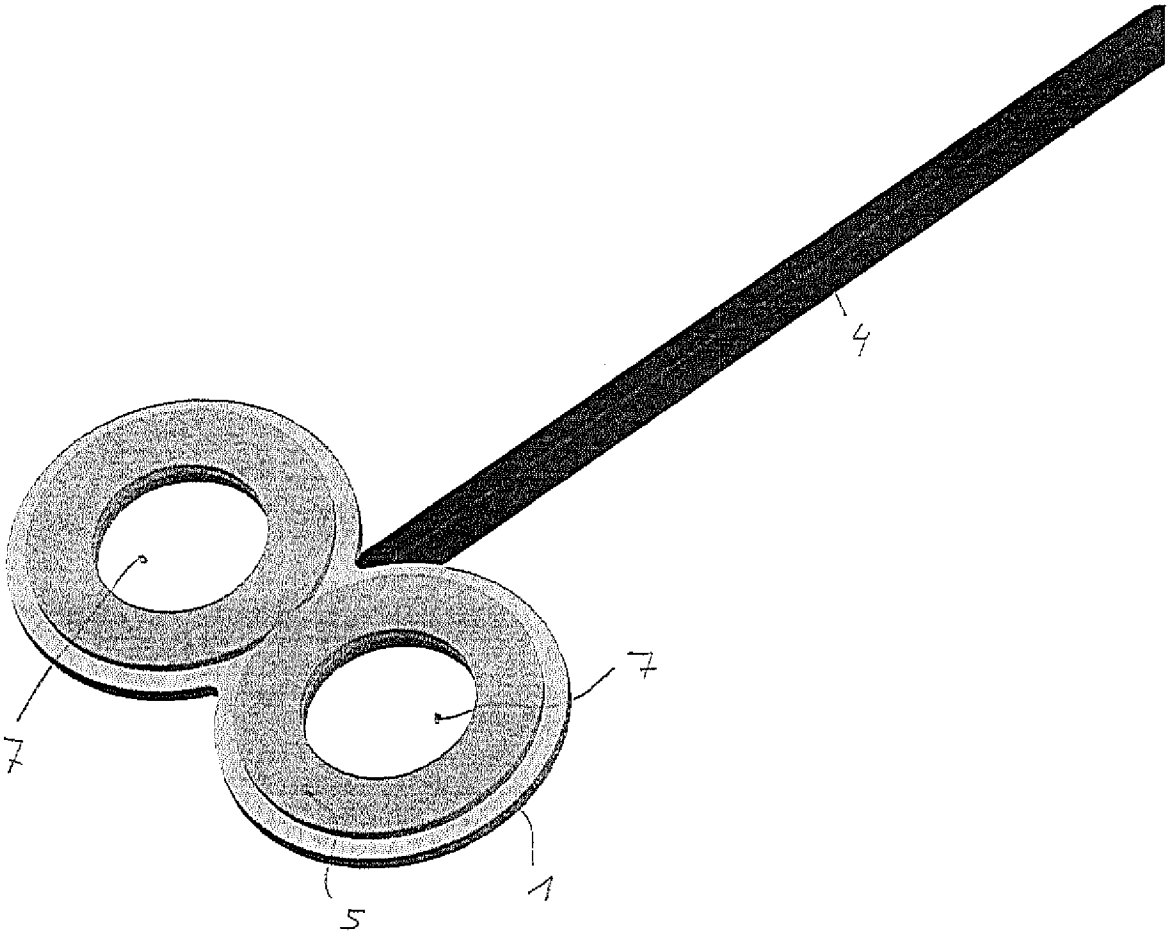
FIG. 2 shows an illustration similar to that of FIG. 1, wherein the view is given from below the connector element, showing the solder blank located there.

However, the solder blank 5 does not extend to the outer edge of the soldering foot. Rather, a distance exists between the respective outside edges, as can be seen in FIG. 2.

The end sheath 2 of the conductor 3 is located in a flat and continuous segment 6 where the circular rings engage in each other or touch each other.

The end sheath 2 is attached to the soldering foot 1 by means of a welding or soldering process, for example.

The conductor itself 3 is fixed in the end sheath 2 by means of a crimping step.

The bonding material 5 is a lead-free solder alloy, for example Bi57Sn42Ag1, Bi57Sn40Ag3, SnAg3.8Cu0.7, Sn55Bi44Ag1 or Sn95.5Ag3Cu0.5.

Moreover, a minimum size of the open area 7 enclosed by each of the circular rings is essential for the embodiment of the electrical connector element.

The invention claimed is:

1. An electrical connector element for creating an electrical contact with a conductive structure located on a flat support via a thermal bonding material, comprising a soldering foot having a front side and a back side;

a thermal bonding material that is provided on the back side of the soldering foot; and a conductor that is fixed on the front side of the soldering foot, wherein the soldering foot includes at least two continuous circular rings that form a figure eight, wherein an outline of an opening of each of the circular rings is a circle as viewed in top plan view, and wherein the figure eight is symmetrical, wherein the conductor is fixed in a flat and continuous region of the soldering foot where the circular rings of the figure eight engage with or touch one another, wherein the conductor extends outside of the circular rings and in a direction that is perpendicular to an axis that passes through a diameter of each of the circular rings and the flat and continuous region of the soldering foot, wherein the connector element comprises an iron-nickel or iron-chromium alloy, or a mixture thereof, and wherein the thermal bonding material is a lead-free solder.

2. An electrical connector element according to claim 1, wherein the thermal bonding material is applied to one side of the connector element within an area that is smaller than the total surface area of the circular rings.

3. An electrical connector element according to claim 2, wherein the bonding material is a solder blank.

4. An electrical connector element according to claim 1, wherein the iron-chromium-alloy comprises FeCr28.

5. An electrical connector element according to claim 1, wherein the iron-chromium-alloy comprises at least one selected form the group consisting of FeNi42, FeNi48, and FeNi52.

6. An electrical connector element according to claim 1, wherein the conductor is flexible.

7. An electrical connector element according to claim 1, wherein the lead-free solder is at least one selected from the group consisting of Bi57Sn42Ag1, Bi57Sn40Ag3, SnAg3.8Cu0.7 and Sn55Bi44Ag1.

8. An assembly, comprising a flat support;

a conductive structure located on the flat support; and the electrical connector element of claim 1 that is provided on the flat support.

9. An electrical connector element according to claim 1, wherein the connector element has a coefficient of expansion of about $9\times10^{-6}$/K.

* * * * *